US006073397A

United States Patent [19]

Tanimoto et al.

[11] Patent Number: 6,073,397

[45] Date of Patent: Jun. 13, 2000

[54] OUTSIDE DOOR HANDLE ASSEMBLY

[75] Inventors: Tetsuro Tanimoto, Anjo; Morihito Nomura, Toyoake; Kouji Ooe, Nagoya; Kouichi Nagata, Obu, all of Japan

[73] Assignee: Aisin Seiki Kabushiki Kaisha, Kariya, Japan

[21] Appl. No.: 09/219,881

[22] Filed: Dec. 24, 1998

[30] Foreign Application Priority Data

Dec. 25, 1997 [JP] Japan ..... 9-356983

[51] Int. Cl.[7] ..... E05B 3/00

[52] U.S. Cl. ..... 49/460; 16/112; 74/543; 292/336.3

[58] Field of Search ..... 49/460, 503; 292/336.3; 16/110 R, 112; 74/543

[56] References Cited

U.S. PATENT DOCUMENTS

| | | | |
|---|---|---|---|
| 4,634,161 | 1/1987 | Fukasawa et al. | 292/336.3 |
| 4,914,779 | 4/1990 | Nakai et al. | 16/124 |
| 5,428,879 | 7/1995 | Miller et al. | 29/418 |
| 5,651,163 | 7/1997 | Tamaki | 16/112 |

FOREIGN PATENT DOCUMENTS

| | | |
|---|---|---|
| 7-39772 | 5/1995 | Japan . |
| 8-4367 | 9/1996 | Japan . |

*Primary Examiner*—Daniel P. Stodola
*Assistant Examiner*—Curtis A. Cohen
*Attorney, Agent, or Firm*—Burns, Doane, Swecker & Mathis, LLP

[57] ABSTRACT

An outside door handle assembly includes a door handle for opening and closing a vehicle door, a case for being fixed to a door panel which stores and retains the door handle and an elastic member generating an elastic force between the door handle and the case, wherein the door handle includes a pair of arm portions which are disposed on right and left sides of the door handle respectively, the case includes two pairs of stay portions each of which are disposed on right and left sides of the case and a storing portion storing the elastic member, each of the arm portions includes a pair of groove portions which are disposed on respective surfaces of the arm portion and an opening which is connected to one of the groove portions in the depth direction of the groove portion such that a depth of the opening is larger than that of the groove portion and such that a diameter of the opening is smaller than that of the groove portion, one stay portion of each pair of stay portions includes a first axle portion which is fit into one of the groove portions of the arm portion and a second axle portion which is disposed on a tip of the first axle portion and which is fit into the opening, the other stay portion of each pair of stay portions includes a third axle portion which is fit into the other one of the groove portions of the arm portion and which is coaxial with the first axle portion and the second axle portion.

15 Claims, 6 Drawing Sheets

OUTSIDE DOOR HANDLE ASSEMBLY

This application corresponds to and claims priority under 35 U.S.C. § 119 with respect to Japanese Application No. 09(1997)-356983 filed on Dec. 25, 1997, the entire content of which is incorporated herein by reference.

FIELD OF THE INVENTION

The present invention generally relates to door handles. More particularly, the present invention pertains to an outside door handle assembly that is useful in a vehicle door.

BACKGROUND OF THE INVENTION

A known outside door handle assembly is disclosed in Japanese Patent Laid Open Publication No. 8(1996)-4367. This outside door handle assembly includes a door handle which is operated to open and close a door, a case fixed to the door panel for rotatably retaining the door handle, and a spring disposed on the case to generate an elastic force between the case and the door handle.

The door handle used in the outside door handle assembly includes a pair of arm portions disposed at right and left portions of the door handle. The case is provided with two pairs of stay portions which are disposed at the right and left portions of the case respectively. Each of the stay portions includes a groove portion (possessing an overhang portion) and a concave portion. An element of the arm portion passes through the groove portion so as to fit the element of the arm portion into the concave portion so that the door handle is rotatably mounted on the case.

In this known outside door handle assembly, because each of the stay portions must be bent in order to pass the element of the door handle through the over hang portions when each of the element is fit into the concave portion of the case during assembly, the door handle must be pressed to the case with a large force.

Further, when the outside door handle assembly is assembled, the spring is moved into the case in the direction perpendicular to the direction in which the door handle is mounted on the case. This has an adverse affect on the convenience of the assembly procedure.

In an attempt to try to avoid the above disadvantages, the axis or the over hang portion can be reduced in size so that the door handle can be installed on the case with a small force. However, the door handle is then apt to fall out of the case.

In light of the foregoing, a need exists for an outside door handle assembly which is convenient to assemble and is not susceptible to falling out of the case.

SUMMARY OF THE PRESENT INVENTION

In light of the foregoing, one aspect of the present invention involves an outside door handle assembly that includes a door handle for opening and closing a vehicle door, a case that is adapted to be fixed to a door panel which stores and retains the door handle, and an elastic member generating an elastic force between the door handle and the case. The door handle includes a pair of arm portions which are disposed on right and left sides of the door handle. The case includes two pairs of stay portions disposed on right and left sides of the case and a storing portion storing the elastic member. Each arm portion includes a pair of groove portions which are disposed on respective surfaces of the arm portion and an opening which is connected to one of the groove portions in the depth direction of the groove portion such that the depth of the opening is larger than that of the groove portion and such that the diameter of the opening is smaller than that of the groove portion. One stay portion of each pair of stay portions includes a first axle portion which is fit into one of the groove portions of the arm portion and a second axle portion which is disposed on a tip of the first axle portion and which is fit into the opening. The other stay portion of each pair of stay portions includes a third axle portion which is fit into the other one of the groove portions of the arm portion and which is coaxial with the first axle portion and the second axle portion.

BRIEF DESCRIPTION OF THE DRAWING FIGURES

Additional features and characteristics of the present invention will become more apparent from the following detailed description considered with reference to the accompanying drawing figures in which like elements are designated by like reference numerals and wherein.

DETAILED DESCRIPTION OF THE INVENTION

Figure 1:
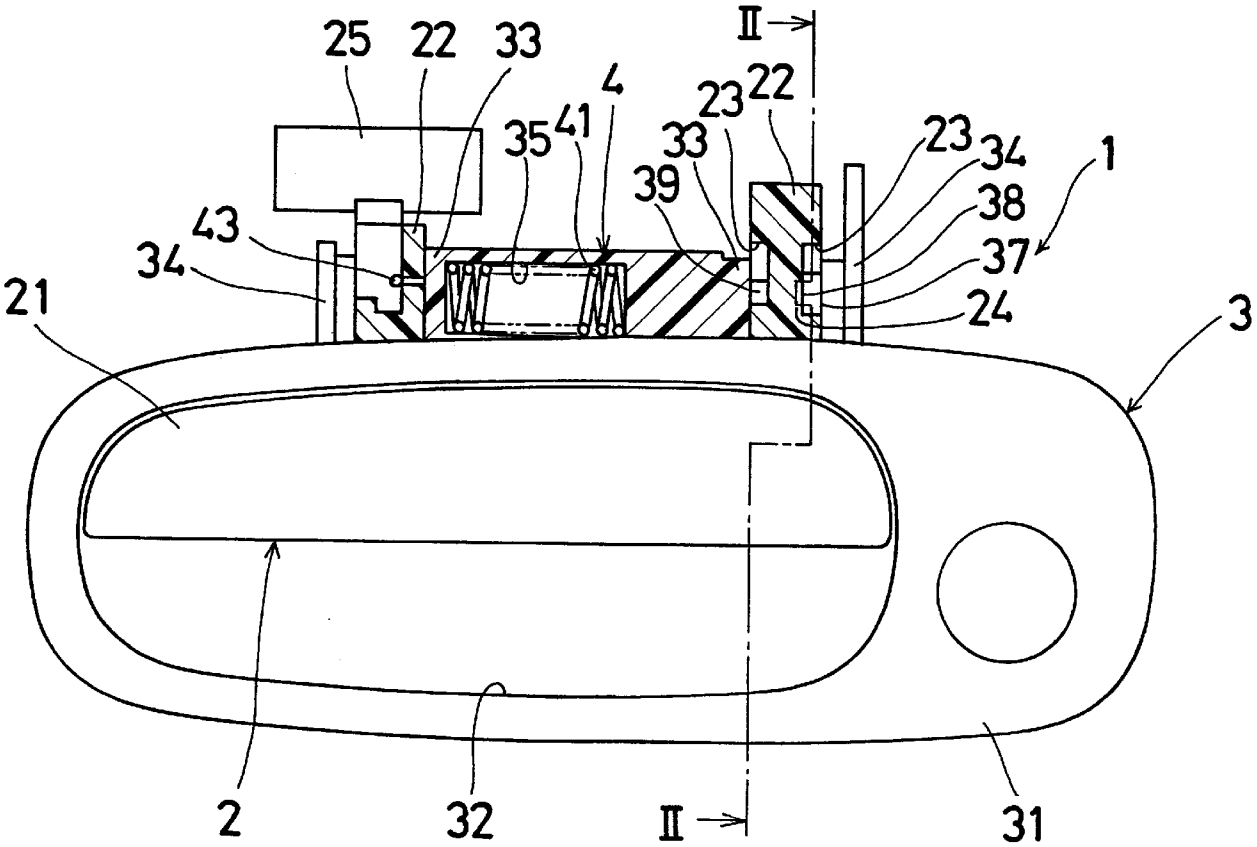
FIG. 1 is an elevational view of the outside door handle assembly according to the present invention.
Figure 2:
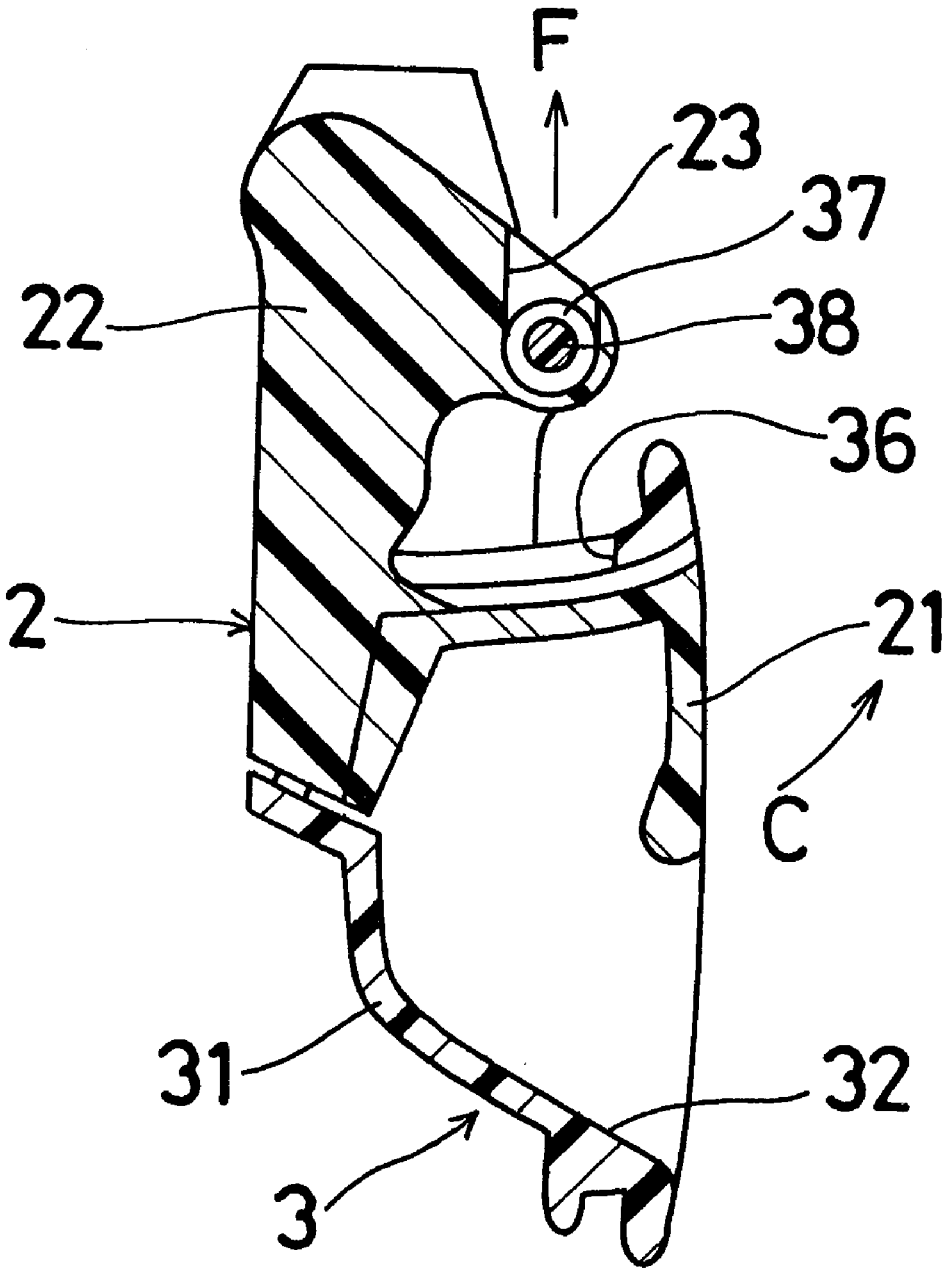
FIG. 2 is a cross-sectional side view of the outside door handle assembly of the present invention taken along the section line II—II in FIG. 1.
Figure 3:
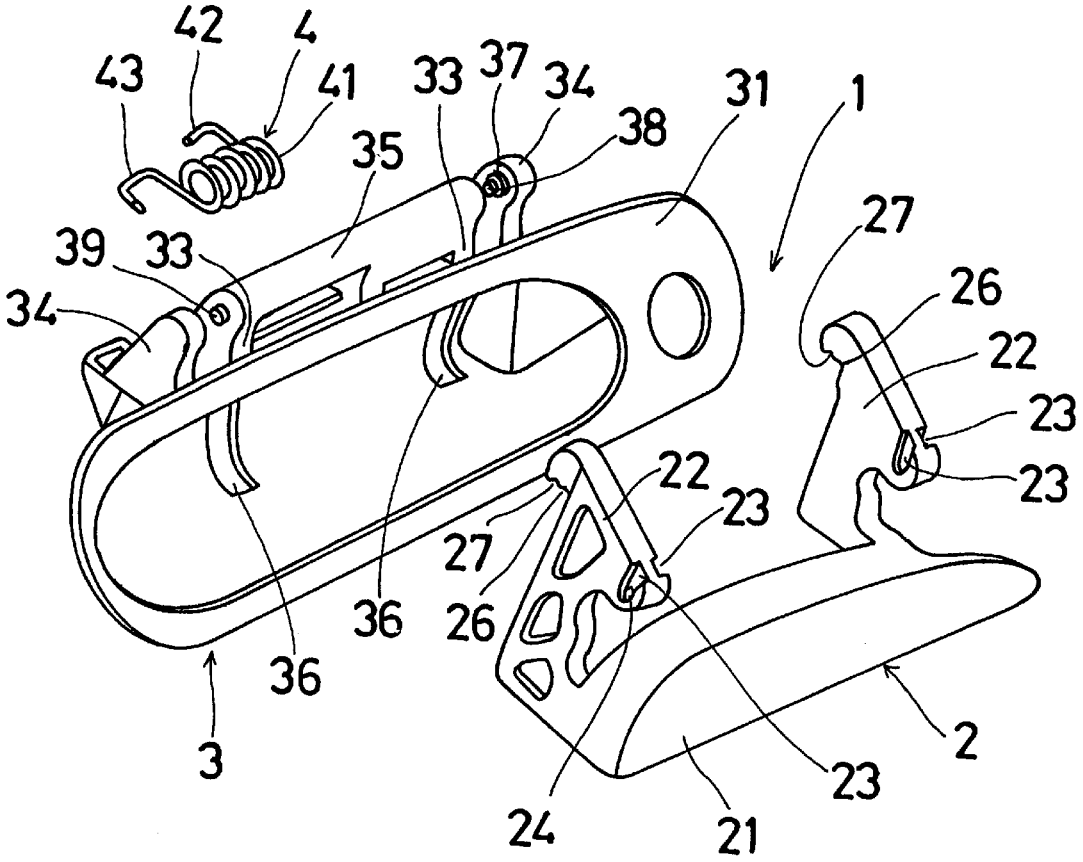
FIG. 3 is an exploded perspective view of the outside door handle assembly of the present invention.

Referring initially to FIGS. 1–3, the outside door handle assembly 1 of the present invention is mainly comprised of a door handle 2, a case 3, and a spring 4. The door handle 2, which is formed of a synthetic resin, includes a handle portion 21 which possesses a plate-shaped configuration. The door handle 2 includes a pair of arm portions 22 which are integrally formed with the handle portion 21. As best seen in FIG. 3, the arm portions 22 are disposed on the rear surface of the handle portion 21 and are parallel to each other. The arm portions 22 extend from the right and left sides or opposite sides of the door handle 2 respectively and possess a generally inverted L-shaped configuration.

The case 3 is formed of synthetic resin and includes a base portion 31 that is adapted to be fixed to the outer panel of the vehicle door, and a frame portion 32 surrounding the handle portion 21 of the door handle 2. The handle portion 21 of the door handle 2 and the frame portion 32 of the case 3 lie in a common plane when the door handle 2 and the case 3 are assembled.

The case 3 further includes two pairs of stay portions 33, 34 which are parallel to one another. Each pair of the stay portions 33, 34 extends from right and left sides or opposite sides of the base portion 31. The stay portions 33, 34 also extend from the rear surface of the base portion 31. The stay portions 33, 34 forming each pair are thus positioned in opposite facing relation to each other to have a predetermined distance therebetween. The stay portions 33 are connected to each other with a storing portion 35 being located between the stay portions 33. The storing portion 35 includes or houses the spring 4.

A pair of slots 36 is disposed on the base portion 31, with each of the arm portions 22 of the door handle 2 passing through a respective one of the slots 36 so that each of the arm portions 22 is located between the stay portions 33, 34.

Figure 4:
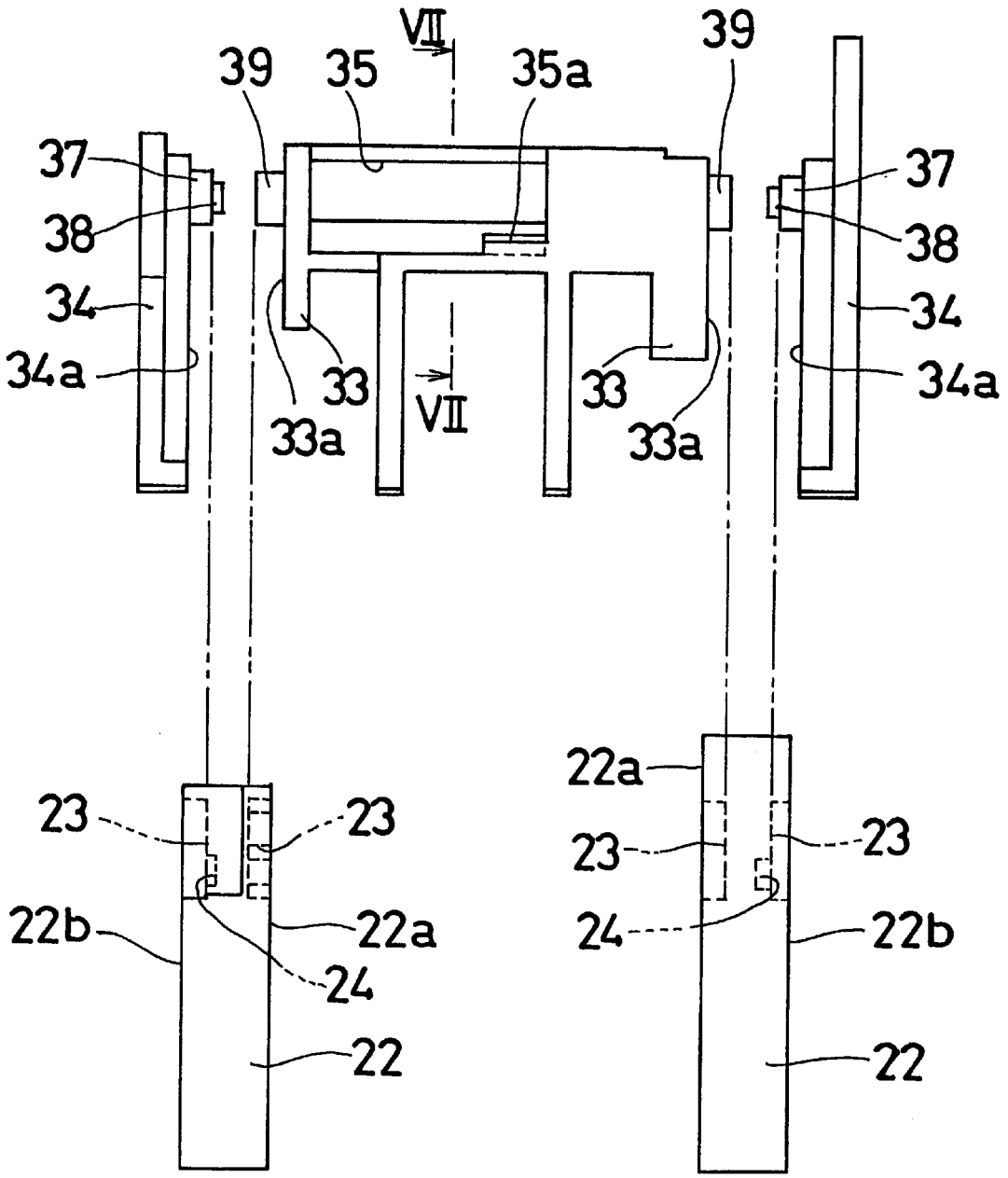
FIG. 4 is an exploded view illustrating the assembly of the door handle into the case of the outside door handle assembly of the present invention.
Figure 5:
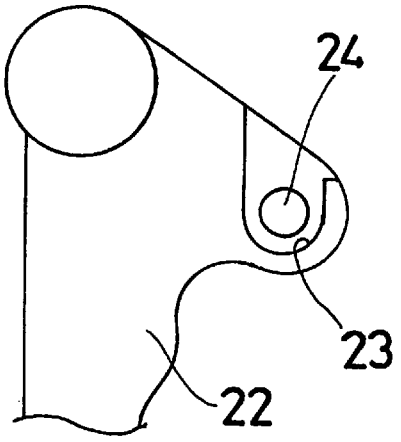
FIG. 5 is a side view of the arm portion of the door handle of the outside door handle assembly of the present invention.
Figure 6:
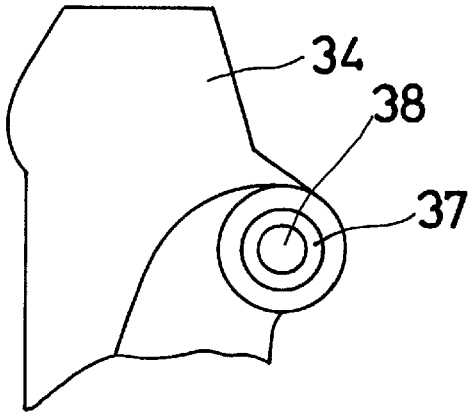
FIG. 6 is a side view of one of the stay portions of the case of the outside door handle assembly of the present invention.
Figure 7:
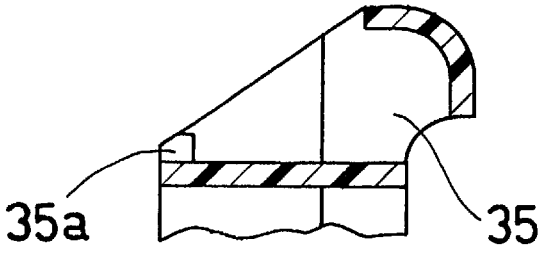
FIG. 7 is a cross-sectional view of the storing portion in the case of the outside door handle assembly of the present invention taken along the section line VII—VII in FIG. 4.

As shown in FIGS. 4–6, the inner surface 22*a* and an outer surface 22*b* of the arm portions 22 are provided with groove portions 23. The groove portions 23 open upwardly. An opening 24 is disposed at the bottom of the groove portion 23 that is located on the outer surface 22*b* of each arm portion 22 so as to be connected to the groove portion 23 in the depth direction of the groove portion 23. The diameter of the opening 24 is smaller than the diameter or size of the groove portion 23.

A first axle portion 37 is disposed on the inner surface 34*a* of each of the stay portions 34. The diameter of each first axle portion 37 is substantially equal to the diameter or size of the groove portion 23 of the arm portion 22. Similarly, the height (i.e., axial extent) of each first axle portions 37 is substantially equal to that of the groove portion 23 of the arm portion 22. A second axle portion 38 is disposed at the tip of the first axle portion 37. The height (axial extent) of each of the second axle portions 38 is substantially equal to the corresponding dimension (i.e., depth) of the opening 24 of the arm portion 22. The diameter of each of the second axle portions 38 is smaller than that of the opening 24 of the Arm portion 22.

A third axle portion 39 is disposed on the outer surface 33*a* of each of the stay portions 33. Both the diameter and the height (i.e., axial extent) of each of the third axle portions 39 is substantially equal to the corresponding dimension of the groove portion 23 on the inside surfaces of the arm portion 22. The first axle portions 37, the second axle portions 38 and the third axle portions 39 are coaxial to one another.

With the outside door handle assembly constructed as described above, when the door handle 2 is assembled in the case 3, the door handle 2 is pressed into the case 3 such that each of the stay portions 34 is bent outwardly in the outer direction by the height (i.e., axial extent) of the second axle portion 38. This allows the first axle portions 37, the second axle portions 38 and the third axle portions 39 to pass through the groove portions 23, with the second axle portions 38 being loosely fitted into the opening 24. The door handle 2 is thus retained by the case 3 so as to be rotatable about the axes of the first axle portions 37, the second axle portions 38 and the third axle portions 39. Because the stay portions 33 do not have to be bent when the door handle 2 is assembled in the case 3, the door handle 2 can be advantageously installed on the case 3 with a small force.

As shown in FIGS. 4 and 7–9, the storing portion 35 of the case 3 possesses a substantially arc-shaped configuration in cross-section to receive a winding portion 41 of the spring 4. At the rear side of the case 3, the storing portion 35 opens in the direction substantially parallel to the assembly direction of the door handle 2 in the case 3. A hook portion 35*a* is disposed on the bottom wall of the storing portion 35. Each of the arm portions 22 of the door handle 2 is provided with an engaging groove 26 which opens in the same direction as the storing portion 35. A guide wall 27 is also provided so as to be connected to the engaging groove 26.

One end 42 of the spring 4 is engaged with the hook portion 35*a* of the storing portion and the other end 43 of the spring 4 is engaged with the engaging groove 26 on the arm portion 22. Therefore, the spring 4 is mounted on the case 3 in a way that generates an elastic force between the door handle 2 and the case 3. Consequently, the door handle 2 is forced in the clockwise direction in FIG. 2 such that the door handle 2 is stored in the frame portion 32.

Figure 8:
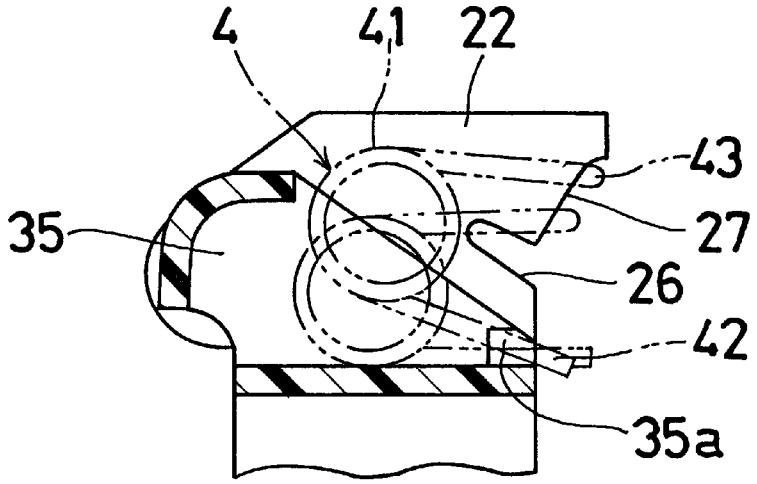
FIG. 8 is a cross-sectional side view illustrating the assembly of the elastic member in the case of the outside door handle assembly of the present invention.
Figure 9:
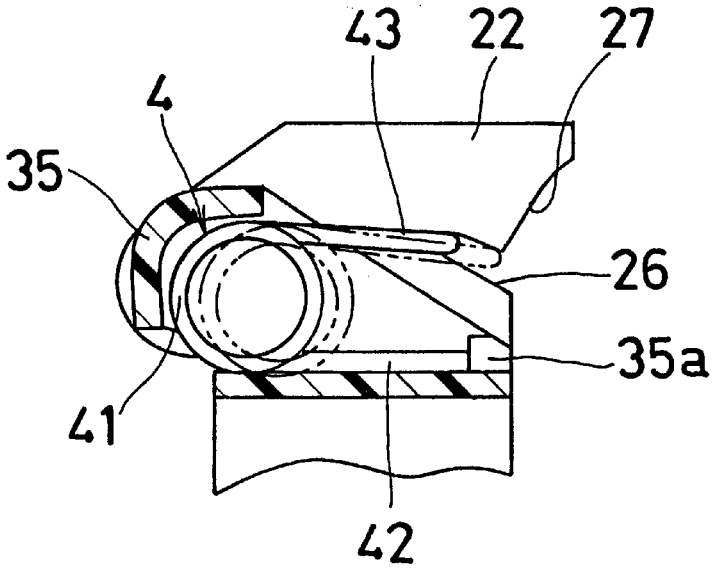
FIG. 9 is a cross-sectional side view illustrating the assembly of the elastic member to the case of the outside door handle assembly of the present invention.

As shown in FIGS. 8 and 9, the spring 4 is housed in the storing portion 35 by pressing it into the case 3. Because the hook portion 35*a* is arranged perpendicular to the press direction of the spring 4, one end 42 of the spring 4 is automatically engaged with the hook portion 35*a*. At this time, the other end 43 of the spring 4 is forced in the clockwise direction in FIG. 8 to engage the other end 43 of the spring 4 with the engaging groove 26 on one of the arm portions 22. The installation of the spring 4 in the case 3 is thus completed.

As shown in FIG. 1, a contact portion 25 which is able to be in contact with an open lever is integrally formed with a tip of one of the arm portions 22 of the door handle 2. The contact portion 25 comes in contact with the open lever to open the vehicle door when the door handle 2 is rotated in the direction indicated an arrow C in FIG. 2 relative to the case 3 against the elastic force of the spring 4.

In accordance with the outside door handle assembly 1 of the present invention, when the door handle 2 is operated in the direction of the arrow C in FIG. 2 with a large amount of force in order to open the vehicle door, the force is applied to an axial portion of the door handle 2, including the groove portions 23 and the opening 24 in the direction indicated by the arrow F in FIG. 2. Because the second axle portion 38 of the case 3 is loosely fitted into the opening 24 of the door handle 2, the side walls of the groove portions 23 are in contact with the first axle portion 37 and the third axle portion 39 respectively by the force. Therefore, the engagement between the groove portions 23 and the axle portions 37, 39 opposes the force applied to the axial portion of the door handle 2 to thereby prevent the second axle portion 38 from falling out of the opening 24.

The door handle assembly of the present invention can be conveniently assembled and is not susceptible to falling out of the case.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An outside door handle assembly comprising:

a door handle for opening and closing a vehicle door;

a case for being fixed to a door panel which stores and retains; the door handle; and an elastic member generating an elastic force between the door handle and the case;

wherein the door handle includes a pair of arm portions which are disposed on right and left sides of the door handle respectively, the case includes two pairs of stay portions each of which are disposed on right and left sides of the case and A storing portion storing the elastic member, each of the arm portions includes a pair of groove portions which are disposed on respective surfaces of the arm portion and an opening formed in a bottom surface of one of the groove portions such that a depth of the opening from the surface of the arm portion is larger than that of the groove portion and such that a diameter of the opening is smaller than that of the groove portion, one stay portion of each pair of the stay portions includes a first axle portion which is fit into a partially circular diameter portion of the groove portion of one of the arm portions and a second axle portion which is disposed on a tip of the first axle portion and which is fit into the opening, the other stay portion of each pair of the stay portions includes a third axle portion which is fit into the other one of the groove portions of the arm portion and which is coaxial with the first axle portion and the second axle portion.

2. An outside door handle assembly as recited in claim 1, wherein the other stay portions of the two pairs of stay portions are connected to each other.

3. An outside door handle assembly as recited in claim 2, wherein the storing portion of the case includes an opening which opens in the same direction of the assembly direction of the door handle in the case.

4. An outside door handle assembly comprising:

a door handle for opening and closing a vehicle door;

a case for being fixed to a door panel and retaining the door handle, the case including a pair of stays and a storing portion; and an elastic member positioned in the storing portion and operatively connected to the case and the door handle to generate an elastic force between the door handle and the case;

the door handle including a pair of arm portions each having oppositely positioned first and second side surfaces, the first side surface of at least one of said arm portions having a groove portion formed therein, said groove portion being defined by a bottom surface and a sidewall, said at least one arm portion being provided with an opening extending from the bottom surface of the groove portion toward the second side surface of the at least one arm portion, said opening having a smaller diameter than said groove, one of said stay portions including a first axle portion and a second axle portion that are coaxial with one another, said first axle portion being received in said groove portion so that said sidewall of the groove portion at least partially surrounds a portion of the first axle portion, said second axle portion being disposed on a tip of said first axle portion and being received in said opening.

5. An outside door handle assembly as recited in claim 4, the case includes a pair of third axle portions that are coaxial with said first and second axle portions, said second side surface of each arm portion including a groove into which extends one of said third axle portions.

6. An outside door handle assembly as recited in claim 5, wherein said pair of stays constitute first stays, said case including a pair of second stays, each of said third axle portions being provided on one of said second stays.

7. An outside door handle assembly as recited in claim 6, wherein both of said second stays are positioned between said first stays.

8. An outside door handle assembly as recited in claim 4, wherein said second side surfaces of said arm portions face towards one another.

9. An outside door handle assembly as recited in claim 4, wherein said door handle is assembled into said case in an assembly direction, the storing portion of the case including an opening which opens in the same direction as the assembly direction.

10. An outside door handle assembly as recited in claim 4, wherein the first side surfaces of both arm portions having a groove portion formed therein and an opening, and both of said stay portions including a first axle portion and a second axle portion that are coaxial with one another.

11. An outside door handle assembly comprising:

a door handle for opening and closing a vehicle door;

a case for being fixed to a door panel and retaining the door handle, the case including a first stay and a second stay; and an elastic member positioned in the storing portion and operatively connected to the case and the door handle to generate an elastic force between the door handle and the case;

the door handle including a first arm portion and a second arm portion, one of said first stay and said first arm portion being provided with a groove portion and an opening, and the other of said first stay and said first arm portion being, provided with first and second axle portions that are coaxial with one another, said second axle portion being disposed at an end of the first axle portion, said opening having a smaller diameter than said groove portion, said groove portion having a bottom surface and a sidewall, said opening extending away from said bottom surface of said groove portion, said first axle portion being received in said groove portion and at least partially surrounded by a portion of said sidewall of the groove portion, said second axle portion being received in said opening.

12. An outside door handle assembly as recited in claim 11, wherein said groove portion is a first groove portion, the case including a pair of third axle portions that are coaxial with said first and second axle portions, each arm portion including a second groove into which extends one of said third axle portions.

13. An outside door handle assembly as recited in claim 12, wherein said first and second stays constitute a first pair of stays, said case including a second pair of stays, each of said third axle portions being provided on one of said stays constituting the second pair of stays.

14. An outside door handle assembly as recited in claim 13, wherein said second pair of stays is positioned between said first pair of stays.

15. An outside door handle assembly as recited in claim 11, wherein said groove and said opening are formed in said first arm portion, and said first and second axle portions are provided on said first stay.

* * * * *